United States Patent [19]

Askonen

[11] Patent Number: 5,076,578

[45] Date of Patent: Dec. 31, 1991

[54] HANDLE FOR AN EXERCISE DEVICE

[76] Inventor: Arto A. Askonen, Untamonkatu 50 C, SF-53100 Lappeenranta, Finland

[21] Appl. No.: 469,455

[22] PCT Filed: Oct. 2, 1987

[86] PCT No.: PCT/FI87/00133

§ 371 Date: May 30, 1990

§ 102(e) Date: May 30, 1990

[87] PCT Pub. No.: WO89/02767

PCT Pub. Date: Apr. 6, 1989

[51] Int. Cl.[5] ..... A63B 21/00

[52] U.S. Cl. ..... 272/143; 272/118

[58] Field of Search ..... 272/62, 63, 67, 68, 272/93, 116, 117, 118, 119, 122, 123, 125, 126, 132, 137, 143

[56] References Cited

U.S. PATENT DOCUMENTS

| | | | |
|---|---|---|---|
| 3,355,171 | 11/1967 | Oesau | 272/125 |
| 3,640,525 | 2/1972 | Proctor | 272/132 |
| 3,713,653 | 1/1973 | Romans . | |
| 3,759,512 | 9/1973 | Yount et al. | 272/132 X |
| 4,148,479 | 4/1979 | Spector | 272/143 X |
| 4,211,402 | 7/1980 | Carroll | 272/143 X |
| 4,344,615 | 8/1982 | Carlson | 272/67 |
| 4,428,577 | 1/1984 | Weingardt | 272/137 X |
| 4,634,127 | 1/1987 | Rockwell | 272/143 X |

FOREIGN PATENT DOCUMENTS

| | | | |
|---|---|---|---|
| 134489 | 3/1933 | Austria | 272/125 |
| 3326426 | 1/1985 | Fed. Rep. of Germany . | |
| 3506855 | 1/1986 | Fed. Rep. of Germany . | |

*Primary Examiner*—Robert Bahr

*Attorney, Agent, or Firm*—Cushman, Darby & Cushman

[57] ABSTRACT

A handle for an exercise device, comprising a central, longitudinal rod and two two-branch forks provided to extend generally in axially opposite directions in a common plane at the opposite ends of the rod. The branches of each fork are transverselly interconnected intermediate their longitudinal extent, by a rod. The branches of the two forks and the two transverse rods form handles which are suitable for providing the different movements of the exercise device to which the handle, in use, is connected. The central rod also forms gripping handles for the different movements. In normal intended use, the rod is fixed to an exercise device by means of a sleeve positioned in the middle of the central rod, the central rod being rotatable within the sleeve around the longitudinal axis of the middle of the central rod.

4 Claims, 1 Drawing Sheet

HANDLE FOR AN EXERCISE DEVICE

BACKGROUND OF THE INVENTION

The invention relates to a handle which, in the preferred embodiment, provides a user with five different gripping alternatives for gripping the operating means for an exercising machine to which the handle, in an intended use, is attached.

When training with gymnasium devices, the exerciser can use various handles which enable the performance of different movements. When the exercising movement is changed, the handle also has to be replaced with one more suited for the changed purpose. The degree of use of some handles may be very low, whereas others may be in constant use.

The biggest drawback of prior handles is that they are mostly suited for the performance of a single movement, and when another movement is to be performed, the handle has to be changed as well. In most cases, the changing of the handle is relatively complicated and slow. When two persons exercise by turns with the same device, both using different handles, the constant changing of the handles makes the training very inconvenient and slow. In addition, it is necessary to purchase a plurality of different kinds of handles which for a major part of the time are out of use and merely stored in a handle rack.

SUMMARY OF THE INVENTION

The device according to the invention provides a decisive improvement with respect to the above drawbacks.

The most important advantage of the invention is that various movements can be performed with one in the same handle. The handle need not be replaced when the movement is changed. Training by turns works well and no undesired breaks are left therebetween. Expensive handles need not be kept out of use in a rack.

BRIEF DESCRIPTION OF THE DRAWING

In the following, the invention will be described with reference to the attached drawing, wherein.

DETAILED DESCRIPTION

Figure 1:
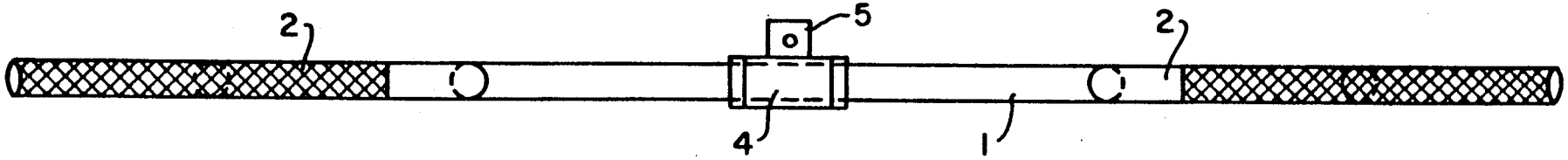
FIG. 1 shows the handle in top plan view, as seen from the side of the two opposite end forks.
Figure 2:
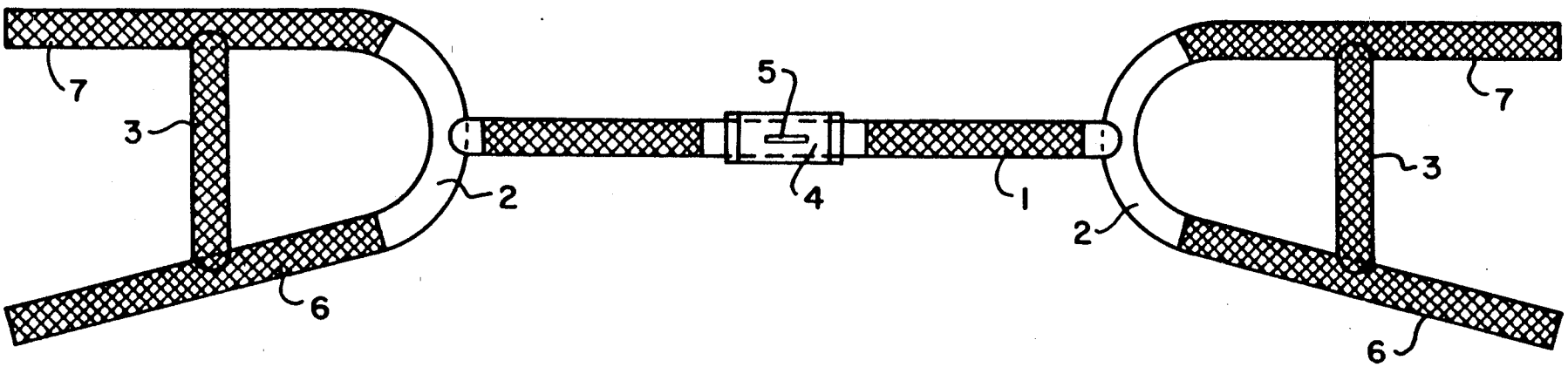
FIG. 2 shows the handle in side elevation as seen from the top of the end forks.

The mid portion of the handle according to the invention is formed by a rod 1 in the middle of which there is provided a sleeve 4. The rod 1 is rotatable around the longitudinal axis thereof within the sleeve 4. The sleeve is provided with a loop or the like 5 by means of which it is intended that the sleeve, and thus the handle, be fastened to the operating means for a conventional exercise device (not shown). The rod 1 may be straight, or so bent that it defines a similar wide angle opening in the same direction on both sides of the sleeve.

Both ends of the rod are provided with respective two-branched fork-like parts 2, the branches 6 and 7 of which are interconnected by a rod 3. The branches 6, 7 of the forks form respective gripping handles for the different movements that an exercising person may want to make in connection with using the exercising device (not shown) to which, in use, the handle is mounted at 5.

The branches 6 of each fork are positioned on the same side of the rod 1 and the direction thereof defines an oblique angle with respect to the longitudinal axis of the rod 1. The other branches 7 are positioned on the opposite side of the rod, substantially in parallel with the rod 1. The rod 3 interconnecting the branches is substantially perpendicular to the longitudinal axis of the rod 1.

The handle is primarily suited for the upper tackle, whereby the end fork and the transverse rod provided therein form gripping handles which are to be pulled so that the rod is rotated to the right position within the suspension sleeve 4. The straight or bent rod 1 in the middle is suitable for the training of extensors in the upper tackle and for the training of flexors in the lower tackle. The handle according to the invention enables a versatile training of the muscles of the shoulder area, back, and arms with one and the same device.

I claim:

1. A handle assembly for actuating an exercise device, comprising:

a tubular sleeve having a longitudinal bore having a longitudinal axis and two axially opposite open ends;

a fixing means provided externally on said tubular sleeve axially intermediate said open ends and projecting laterally for securing said sleeve to an actuator of an exercising device;

a rod means having a central portion which is telescopically received in said longitudinal bore of said sleeve and journalled thereby by rotation about said longitudinal axis; said rod means having two opposite end portions which respectively protrude out from, and beyond respective said opposite ends of said sleeve and have respective outer ends, thereby providing two respective first gripping handles on said rod means between respective opposite ends of said sleeve and respective outer ends of said rod means;

two handle members, each being forked at a respective base so as to provide on each said handle member two laterally spaced second gripping handles which project in a common direction from the respective base thereby providing four respective second gripping handles on said handle members, two on each said handle member; the two handle members being mounted at the respective bases to the respective outer ends of the two opposite end portions of said central portion of said rod means so that the two handle members diverge into the respective said second gripping handles in axially opposite directions outwardly from said central portion of said rod means; and two lateral rods, each having two opposite ends secured to respective second gripping handles of respective said handle members at sites located axially intermediate the longitudinal extent of the respective second gripping handles, thereby laterally interconnecting respective second gripping handles and providing respective third gripping handles, so that at least a usefully grippable part of each second gripping handle extends axially outwardly, with respect to said longitudinal axis of said sleeve, beyond the respective said lateral rod.

2. The handle assembly of claim 1, wherein:

on each said handle member one said second gripping handle has a longitudinal axis which is substantially parallel to said longitudinal axis of said tubular sleeve, and the other said second gripping handle has a longitudinal axis which is oblique to said longitudinal axis of said tubular sleeve.

3. The handle assembly of claim 2, wherein:

both said one second gripping handles are laterally offset in a common direction from said longitudinal axis of said tubular sleeve, and both said other second gripping handles are laterally offset in a laterally opposite direction from said longitudinal axis of said tubular sleeve.

4. The handle assembly of claim 3, wherein:

said two lateral rods have respective longitudinal axes which are substantially coplanar and perpendicular to said longitudinal axis of said sleeve.

* * * * *